US008936486B2

(12) United States Patent
Holliday et al.

(10) Patent No.: US 8,936,486 B2
(45) **Date of Patent: *Jan. 20, 2015**

(54) COAXIAL CABLE CONNECTOR

(71) Applicant: PPC Broadband, Inc., East Syracuse, NY (US)

(72) Inventors: Randall A. Holliday, Broomfield, CO (US); Robert M. Parker, Aurora, CO (US); Ting Ying Huang, Taipei (TW); Joshua M. Dixon, Memphis, TN (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,301

(22) Filed: Nov. 22, 2013

(65) Prior Publication Data

US 2014/0080359 A1 Mar. 20, 2014

Related U.S. Application Data

(63) Continuation of application No. 13/438,531, filed on Apr. 3, 2012, now Pat. No. 8,591,255.

(60) Provisional application No. 61/472,082, filed on Apr. 5, 2011.

(51) Int. Cl.
*H01R 9/05* (2006.01)
*H01R 24/40* (2011.01)
(Continued)

(52) U.S. Cl.
CPC ..... *H01R 9/05* (2013.01); *H01R 24/40* (2013.01); *H01R 13/5219* (2013.01); *H01R 13/512* (2013.01)
USPC ..... 439/583

(58) Field of Classification Search
CPC ..... H01R 9/05; H01R 13/5219; H01R 24/40; H01R 13/512
USPC ..... 439/271, 277, 578, 583–585
See application file for complete search history.

(56) References Cited

U.S. PATENT DOCUMENTS 5,195,906 A 3/1993 Szegda
6,793,529 B1 9/2004 Buenz
(Continued)

FOREIGN PATENT DOCUMENTS

TW I302768 B 11/2008
TW I307987 3/2009
(Continued)

OTHER PUBLICATIONS

International Search Report and Written Opinion for PCT Application No. PCT/US2012/031981, mailed Oct. 24, 2012, 8 pages.
(Continued)

*Primary Examiner* — Khiem Nguyen
(74) *Attorney, Agent, or Firm* — Hiscock & Barclay, LLP

(57) ABSTRACT

A coaxial cable connector, in one embodiment, includes a first housing, a second housing and an inner body. The inner body is fixed or stationary relative to the first housing based on the position of the second housing. The inner body configured to be moveable relative to the first housing when the second housing is in the first position; and stationary relative to the first housing when the second housing is in the second position.

42 Claims, 8 Drawing Sheets

(51) Int. Cl.
*H01R 13/52* (2006.01)
*H01R 13/512* (2006.01)

(56) References Cited

U.S. PATENT DOCUMENTS

| | | | |
|---|---|---|---|
| 7,241,162 | B1 | 7/2007 | Lawrence |
| 7,381,083 | B2 | 6/2008 | Amidon |
| 7,484,993 | B2 | 2/2009 | Amidon et al. |
| 7,645,160 | B2 | 1/2010 | Tabet |
| 7,794,275 | B2 | 9/2010 | Rodrigues |
| 7,905,744 | B1 | 3/2011 | Amidon |
| 8,075,338 | B1 | 12/2011 | Montena |
| 8,079,860 | B1 | 12/2011 | Zraik |
| 8,113,879 | B1 | 2/2012 | Zraik |
| 2004/0077215 | A1 | 4/2004 | Palinkas et al. |
| 2007/0178722 | A1 | 8/2007 | Amidon et al. |
| 2007/0298646 | A1 | 12/2007 | Malak et al. |
| 2007/0298649 | A1 | 12/2007 | Amidon |
| 2008/0064251 | A1 | 3/2008 | Amidon |
| 2009/0247930 | A1 | 10/2009 | Fung |
| 2010/0255721 | A1 | 10/2010 | Purdy et al. |
| 2011/0003507 | A1 | 1/2011 | Van Swearingen et al. |

FOREIGN PATENT DOCUMENTS

| | | | |
|---|---|---|---|
| WO | 2010141898 | A1 | 12/2010 |
| WO | W02010141898 | A1 | 12/2010 |

OTHER PUBLICATIONS

European Patent Office, Extended European Search Report from EP Appl. No. 12767220.2, dated Jul. 29, 2014, total 9 pgs.

C
45
43
82
70
72
S
76
78
80
43'
42
40
86
58'
60
61
82
56
45
86
58'
62
60
70
78
72
S1
10'
G
84
10
12
C'
L
36
38
73

86
45
68
60
79
62
90
10'
92
C
32
30
60
62
38
36
90
10'
10
12
C'

COAXIAL CABLE CONNECTOR

PRIORITY CLAIM

This application is a continuation of, and claims the benefit and priority of, U.S. patent application Ser. No. 13/438,531, filed on Apr. 3, 2012, which is a non-provisional of, and claims the benefit and priority of, U.S. Provisional Patent Application Ser. No. 61/472,082, filed on Apr. 5, 2011. The entire contents of such applications are hereby incorporated by reference.

BACKGROUND

The present disclosure relates to termination assemblies for splicing together coaxial cables, and more particularly, to novel and improved BNC connectors which can be utilized for standard as well as high-frequency applications, such as, security cameras to minimize return losses. In some embodiments, the novel and improved BNC connectors are conformable for use under adverse weather conditions while at the same time achieving reduction in return losses.

SUMMARY

One embodiment relates to a coaxial cable connector comprising a forward outer housing comprising at least one slot and a rearward threaded portion, the at least one slot configured to receive a corresponding pin of a mating connector; a rear outer housing comprising a forward threaded portion configured to threadingly engage the rearward threaded portion of the forward outer housing such that the rear outer housing is moveable between a first position and a second position relative to the forward outer housing; and an inner body extending through at least a portion of the forward outer housing and the rear outer housing; wherein the inner body is longitudinally displaceable relative to the forward outer housing when the rear outer housing is in the first position and wherein the inner body is longitudinally fixed relative to the forward outer housing when the rear outer housing is in the second position.

Another embodiment relates to a coaxial cable connector comprising a forward outer housing comprising a rearward portion; a rear outer housing comprising a forward portion configured to engage the rearward portion of the forward outer housing such that the rear outer housing is moveable between a first position and a second position relative to the forward outer housing; an inner body extending through at least a portion of the forward outer housing and the rear outer housing; and a biasing member disposed between the inner body portion and at least one of the forward and rear outer housing members, wherein the biasing member provides a biasing force tending to force the forward outer housing member rearward relative to the inner body portion; wherein the inner body is longitudinally displaceable relative to the forward outer housing when the rear outer housing is in the first position and wherein the inner body is longitudinally fixed relative to the forward outer housing when the rear outer housing is in the second position.

Another embodiment relates to a BNC style coaxial cable connector comprising a forward outer housing comprising at least one slot and a rearward portion, the at least one slot configured to receive a corresponding pin on a mating connector; a rear outer housing comprising a forward portion configured to engage the rearward portion of the forward outer housing such that the rear outer housing is moveable between a first position and a second position relative to the forward outer housing; an inner body extending through at least a portion of the forward outer housing and the rear outer housing; a first resilient sealing member disposed between the rear outer housing and the inner body; and a second resilient sealing member disposed between the front outer housing and the inner body and configured to engage a forward portion of the mating connector.

DETAILED DESCRIPTION

Figure 1:
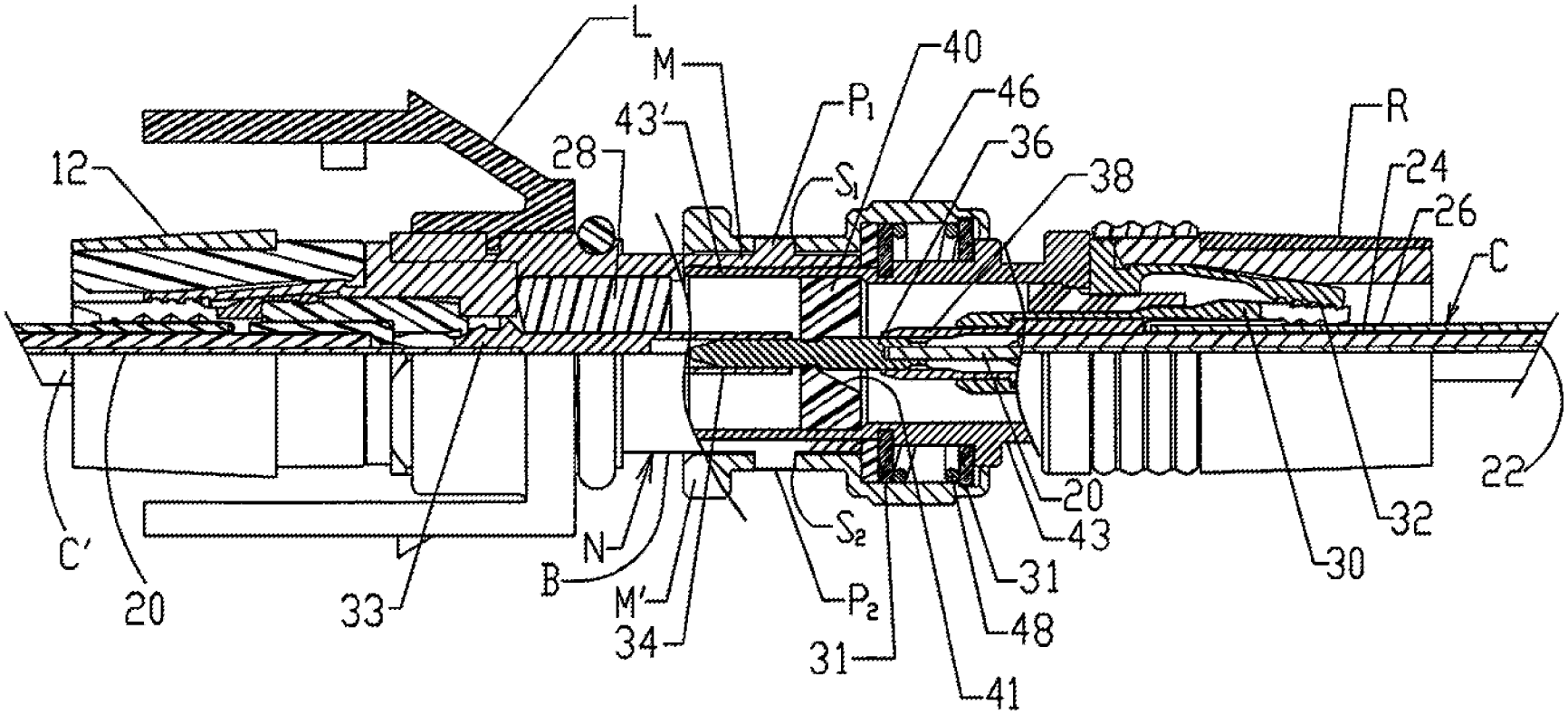
Fig. 1 (PRIOR ART)
FIG. 1 is a view partially in section of a BNC connector for splicing together mini-coaxial cables.

FIG. 1 illustrates a conventional BNC/RGB socket end connector assembly for splicing together mini-coaxial cables C and C' by use of standard female and male socket extensions M and M' of a BNC connector N. The connector N includes a barrel B with the bayonet pins P1 and P2 slidable into the socket portion M', the latter having a pair of bayonet slots S1 and S2. A spring housing 46 for a compression spring 48, which is disposed between end stops 31, is mounted in outer spaced surrounding relation to an inner body or ferrule 43. Also, an extension 43' of ferrule 43 surrounds an internal guide or pin carrier 40 having a tapered central opening 41 for insertion of the extension tip 36 of a center conductor 20 of the cable C.

Each of the coaxial cables C and C' is correspondingly comprised of a center conductor 20 which is surrounded by a dielectric insulator 22 of an electrically non-conductive material, a braided conductor layer 24, and an outer jacket 26 of an electrically non-conductive material. The end of each cable C or C' is further prepared for assembly by removing a limited length of the outer jacket 26 and braided conductor 24, and another limited length of the insulator layer 22 is removed to expose an end of center conductor 20 along with a foil layer, not shown, surrounding center conductor 20. The braided conductor layer 24 is peeled back and away from the insulator 22 and doubled over to cover the leading end of the jacket 26 preliminary to insertion of center conductor 20 into the socket end 34.

The cable C' and its socket end 34 are inserted into a connector body at the end of the female socket M, and a crimping ring 12 is advanced over the inner and outer connector sleeves to crimp the end of the cable C' into position with the leading socket end 34 extending through the inner insulation portion 28 to terminate just short of the guide 40 when the male and female connectors are mated. An outer mounting flange or clamp L is mounted on connector body 10 with a suitable compression tool, not shown. In a corresponding manner, the cable C at the opposite end is inserted into the opposite end of the male connector M', and a crimping ring R is advanced over the outer sleeves 30 and 32 to crimp the end of cable C into position with the extension tip 36 extending into the socket end 34 when the male and female connectors are mated.

The termination assembly of FIG. 1 is illustrated and described in more detail in U.S. Pat. No. 7,326,079 issued Feb. 5, 2008 and entitled "Mini-Coaxial Cable Splice Connector Assemblies and Wall Mount Installation Tool Therefor" to Holliday, et al. Another illustrative BNC connector assembly is set forth and described in U.S. Pat. No. 6,805, 583, issued Oct. 19, 2004 and entitled "Mini-Coax Cable Connector and Method of Installation" to Holliday, et al. Both of these patents are incorporated by reference herein in their entireties. Both patents disclose embodiments directed to maintaining proper alignment and centering of the cables C and C' when advancing into position within a BNC connector, as well as a positive connection to avoid creating an impedance tending to downgrade the signal through the cable and connector. In some embodiments described below, a coaxial cable installation of the type described may be implemented to maintain accurate alignment between the cables in splicing the cables together and/or in resisting axial misalignment between the cables. Some embodiments may reduce unbalanced frequencies. Further embodiments may prevent shorting between the cable layers along with the conductive portions of the connector assembly.

Figure 5:
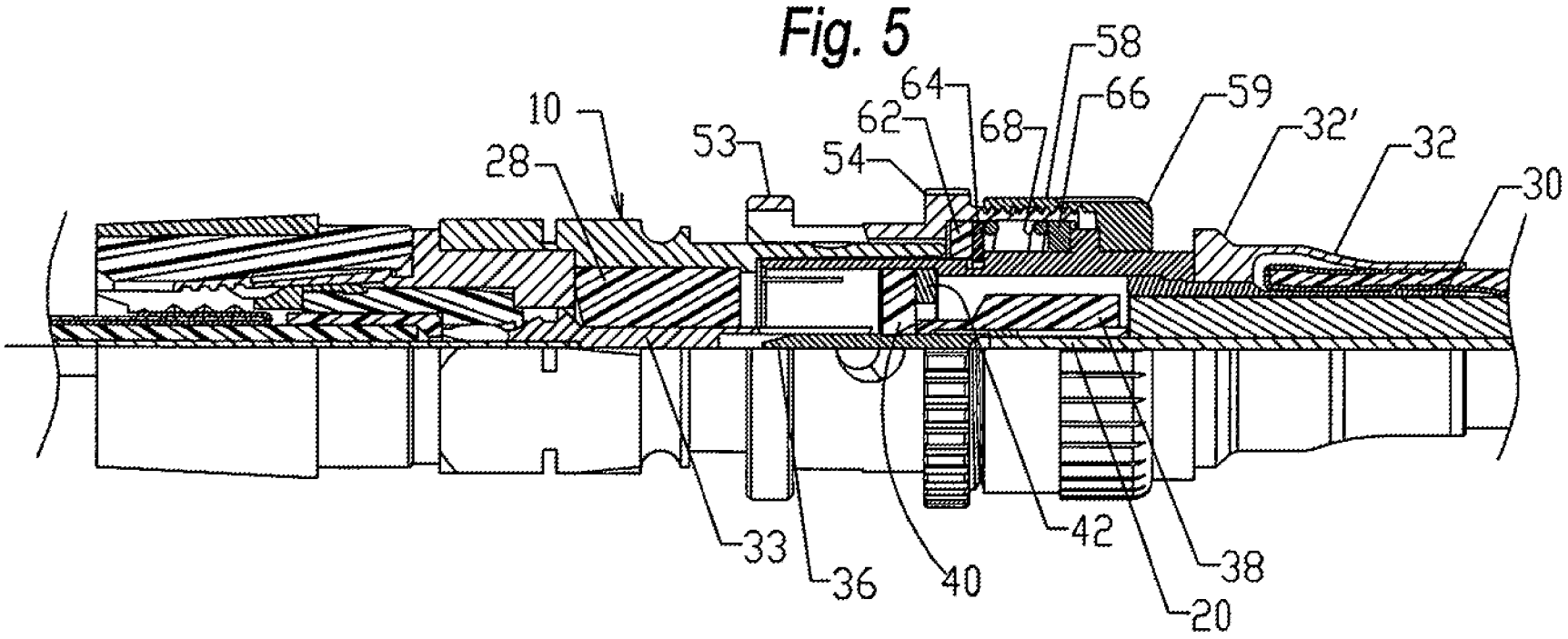
FIG. 5 is another longitudinal section view of the first embodiment of the BNC connector in a closed position.

In some embodiments, a connector is configured to squeeze together elements consisting of an end stop 62, split ring 64, compression spring 68 and a second end stop 66 against lateral or axial movement (see, e.g., FIG. 5). In some embodiments, a connector is configured to lock a connector body extension 10' and an extension 43' as well as a socket end portion 34 and an extension tip 36 against lateral displacement (see, e.g., FIG. 3). In some embodiments, a connector is configured to lock pins P1, P2 axially with respect to slots S1, S2 (see, e.g., FIG. 5). In further embodiments, a BNC male connector minimizes end play between internal components and particularly between the conductive members being spliced together. In yet further embodiments, a predetermined gap is established between certain internal components, such as the dielectric layer of the cable and insulator for the conductor pin.

Figure 2:
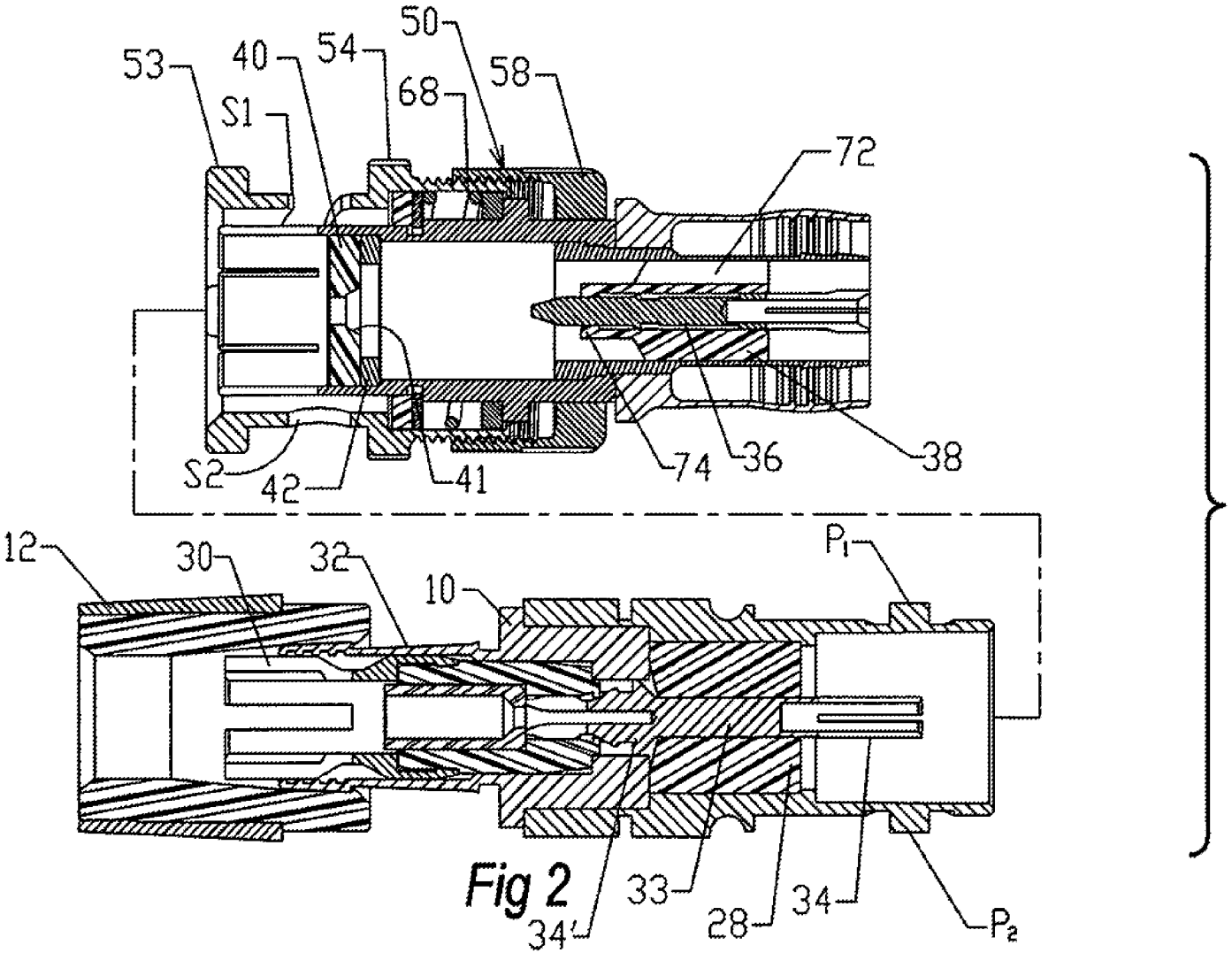
FIG. 2 is an exploded, longitudinal section view of a first embodiment.

Referring to FIG. 2, according to an exemplary embodiment, a male BNC connector 50 includes a forward outer housing 52 (e.g. a ferrule, etc.) and a rear outer housing 58 that engages forward outer housing 52 (e.g., by way of a threaded engagement). An inner body 43 (e.g., a casing, etc.) extends within at least a portion of forward outer housing 52 and rear outer housing 58. An internal guide or pin carrier 40 (e.g., a sleeve, disk, etc.) and a washer 42 are disposed within inner body 43. Inner and outer sleeves 30, 32 extend rearward relative to inner body 43, and an extension tip 36 (which receives the cable center conductor) and extension tip guide 38 are slidable within inner sleeve 30 to move the cable and extension tip 36 to a fully seated position (see, e.g., FIG. 3.) Forward outer housing 52 includes a pair of axially spaced external shoulders 53, 54 on opposite ends of slots S1, S2. Extension tip guide 38 includes a forward portion 74 and a number of external fins or blades 73.

According to an exemplary embodiment, a biasing element 68 (e.g., a coil spring, etc.) is disposed in an annular chamber 60 formed between inner body 43 and forward outer housing 52. According to an exemplary embodiment, annular chamber 60 is further formed by forward and rear outer housings 52, 58 and/or inner body 43. Within annual chamber 60, a first end stop 62 bears against an internal shoulder on forward outer housing 52 and is locked into position by a split ring or snap ring 64. A second end stop 66 is positioned in axially spaced relation to end stop 62 and bears against an external shoulder 45 on inner body 43. Biasing member 68 (e.g., compression spring) may be mounted under compression between snap ring 64 and end stop 66 so as to yieldingly resist threaded advancement of rear outer housing 58 toward external shoulder 54 of forward outer housing 52 until end 59 of rear outer housing 58 abuts shoulder 45. In some embodiments, biasing element 68 provides a biasing force tending to force rear outer housing 58 rearward relative to inner body 43.

Referring to FIGS. 2-5, an embodiment of a termination assembly is shown in which like parts to those of FIG. 1 are correspondingly enumerated. The termination assembly comprises BNC connector 50. As best seen from FIG. 3, the exposed end of center conductor 20 extends into extension tip 36 of the connector 50, and extension tip 33 of the mating connector terminates just short of the end of a pin carrier 40 of connector 50.

When the connectors are mated, socket end portion 34 receives extension tip 36 which projects axially from the leading end of center conductor 20 of cable C. The leading exposed end of center conductor 20 of cable C is housed within a guide or sleeve 38 which extends through washer 42 and adjacent disk 40 when cable C is fully seated. Disk 40 may be of electrically non-conductive material, and central bore 41 of disk 40 serves to guide extension tip 36 in centered relation through connector 50 when cable C is installed. In some embodiments, sleeve 38 terminates at a recessed opening at one end of the bore 41 to guide the sleeve 38 into centered relation to the connector 50 when the cable C is installed. The washer 42 and disk 40 are mounted in an inner body or cylindrical casing 43 having a thin-walled extension 43' Inner body 43 has circumferentially spaced elongated slots 44 at one end which enable close-fitting engagement between inner body 43 of connector 50 and the extension 10' of the mating connector. An end of inner body 43 has a shoulder 16 which is affixed to the inner and outer connector sleeves 30 and 32 for cable C (see, e.g., FIG. 4).

In some embodiments, BNC connector 50 includes ferrule or forward outer housing 52 in outer surrounding relation to thin-walled extension 43' of inner body 43, and axially spaced, external shoulders 53 and 54 at opposite ends of a pair of bayonet slots S1 and S2 on forward outer housing or ferrule 52. In some embodiments, forward outer housing 52 includes an externally threaded thin-walled tubular member 56 that extends beyond or from shoulder 54 in outer spaced concentric relation to inner body or casing 43. Tubular member 56 and rear outer housing 58 axially advance toward each other (e.g., via threading engagement) from the open position (e.g., a first position) shown in FIGS. 3 and 4 into the closed position (e.g., a second position) shown in FIG. 5 until rear outer housing 58 bears against external shoulder 45 of inner body or casing 43. In some embodiments, in the open position, the end 59 of rear outer housing 58 abuts an external shoulder 32' at one end of the outer connector sleeve 32 (see, e.g., FIGS. 4-5).

Figure 3:
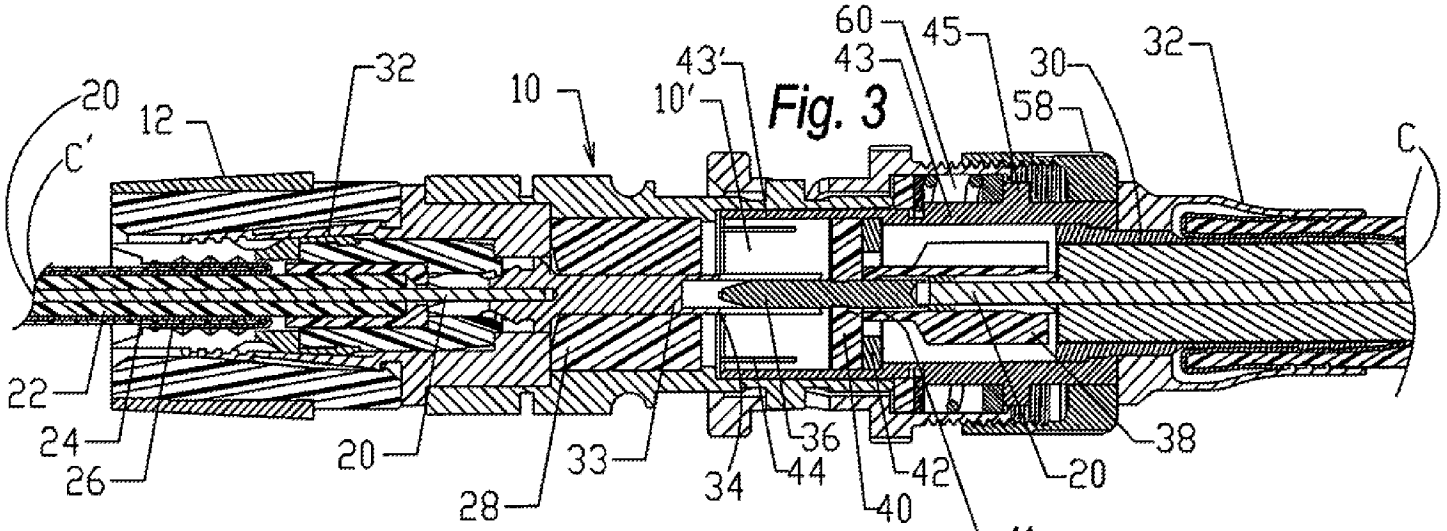
FIG. 3 is a longitudinal section view of the first embodiment in assembled form prior to tightening of the BNC connector components.
Figure 4:
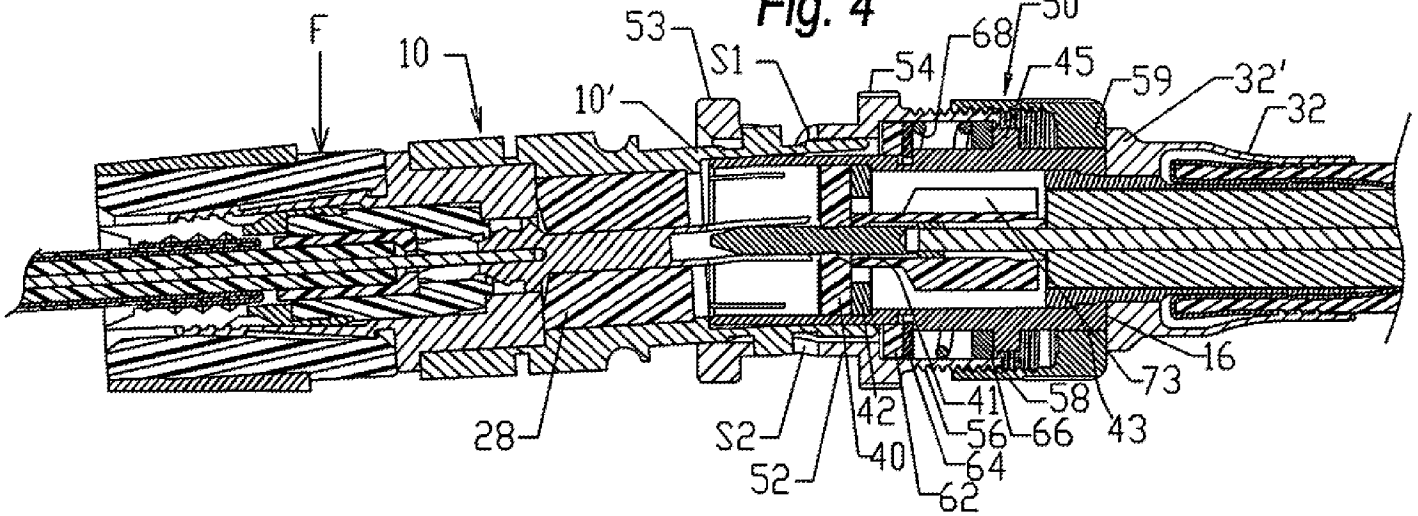
FIG. 4 is a view illustrating the effect of applying a transverse force to the embodiment shown in FIG. 3.

The function of threadedly adjustable rear outer housing 58 can be best appreciated by reference to FIG. 4. When rear outer housing 58 is loosened, as shown in FIGS. 3 and 4, mating connector body 10 and cable C' are free to undergo lateral displacement or bending in response to a transverse force, such as, represented by the arrow F in FIG. 4. As a result, the socket end portion 34 of the mating connector which receives extension tip 36 of connector 50 will tend to spread or move out of axial alignment and distort the frequencies of the signals transmitted between cables C and C'. Accordingly, when tightened, as shown in FIG. 5, rear outer housing 58 is operative or configured to facilitate one or more of: squeezing together the elements consisting of the end stop 62, split ring 64, compression spring 68 and a second end stop 66 against lateral or axial movement; locking the connector body extension 10' and extension 43' as well as the socket end portion 34 and extension tip 36 against lateral displacement; locking pins P1, P2 axially with respect to slots S1, S1; preventing lateral displacement between the thin-walled extension members 10' and 43'; and controlling spacing between center guide 38 and dielectric 22 of cable C.

A second embodiment is illustrated in FIGS. 6-9 wherein like parts to those of FIGS. 2-5 are correspondingly enumerated. In addition to the features outlined in the first embodiment, the second embodiment affords an effective means of sealing a precision BNC connector assembly to avoid exposure to moisture or foreign particles when used under adverse weather conditions.

According to an exemplary embodiment, the termination assembly is comprised of a BNC connector 70. The exposed end of center conductor 20 of cable C extends into extension tip 36. Extension tip 36 extends through carrier sleeve 38 having external fins or blades 73, and a leading end 74 of the carrier sleeve 38 is reduced to extend through washer 42. Extension tip 36 continues through washer 42 and guide 40.

In the second embodiment, BNC connector 70 includes a ferrule or forward outer housing 72 in outer surrounding relation to the extension 43' of the inner body 43. In some embodiments, a metal sleeve 76 (e.g., a tube, cylinder, etc.) extends in press-fit or other secure relation over forward outer housing 72, and a thin-walled outer sleeve or overmold 78 (e.g., a resilient or compressible member or layer, etc.) is provided (e.g., molded, etc.) over sleeve 76 with external shoulders 80 and 82 at opposite ends of the overmold 78. In some embodiments, an annular end seal or washer 84 is affixed to shoulder 80 of overmold 78 to serve as a closure between the shoulder 80 and an external shoulder of a connector body of a mating connector (see FIG. 8). A space or gap G at the end of connector 70 communicates with bayonet slots S1 and S2 in order to permit insertion of bayonet pins P1 and P2 into the mating connector slots S1 and S2 prior to attachment of seal 84.

Figures 6, 7, 8, 9:
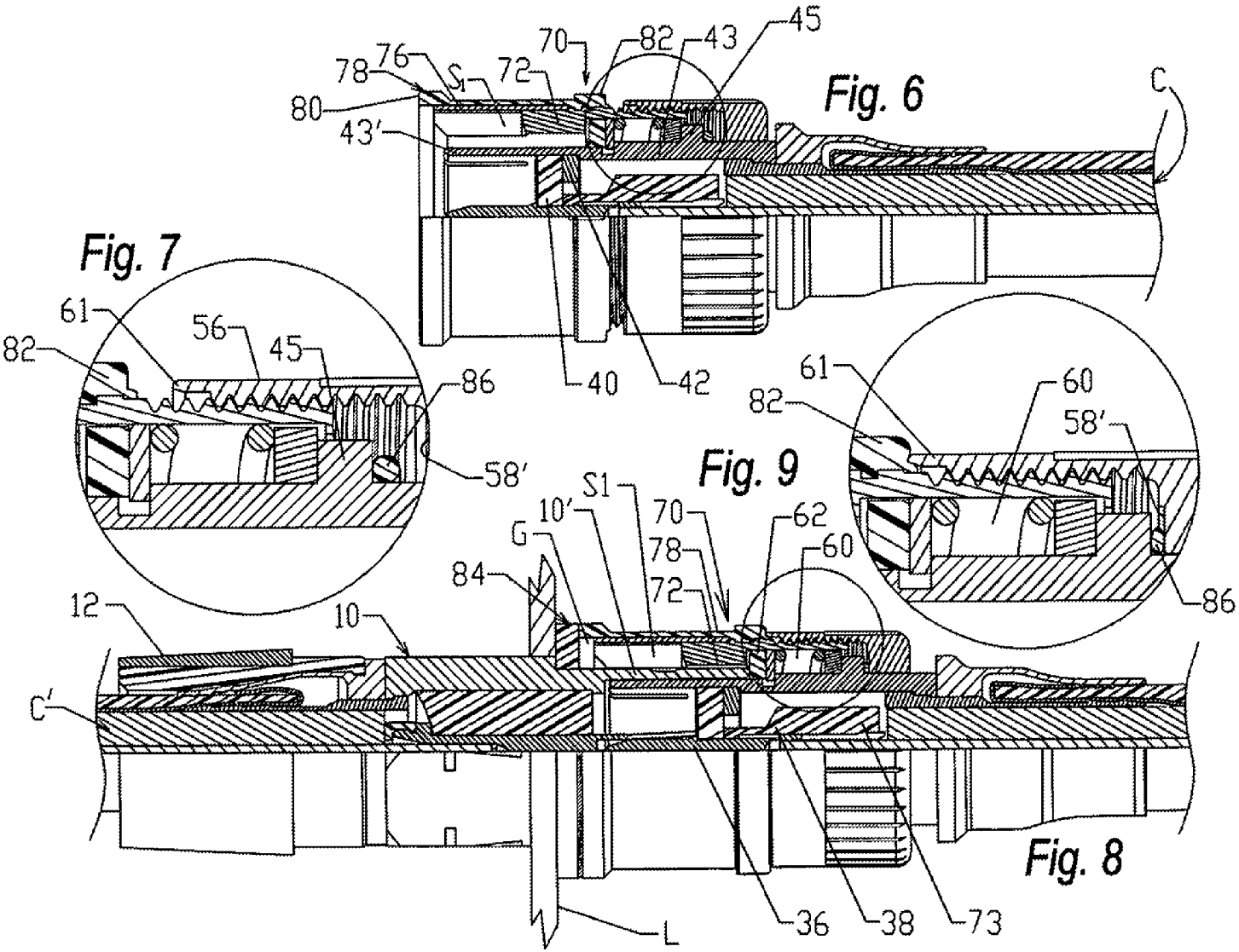
FIG. 6 is a view partially in section of a second embodiment.
FIG. 7 is an enlarged detail view of the circled portion of FIG. 6.
FIG. 8 is a view partially in section of the connector assembly shown in FIG. 6 with the BNC connector shown in a tightened or closed position.
FIG. 9 is an enlarged detail view of the circled portion of FIG. 8.

As best seen from FIGS. 7 and 9, rear outer housing 58 includes a projection 61 at its free end facing overmold 78. When rear outer housing 58 is in a closed or tightened position, projection 61 can advance beyond the threaded portions into engagement with shoulder 82 on the end of overmold 78. Simultaneously, end wall 58' of rear outer housing 58 facing shoulder 45 advances into the closed position, as shown in FIG. 9, causing projection 61 to engage shoulder 82 of overmold 78. According to an exemplary embodiment, when rear outer housing 58 is advanced into the closed position, end wall 58' will engage an O-ring 86 (e.g., a resilient member) which is adjacent shoulder 45 so as to make a sealed engagement at a first potential leak point at the juncture of the projection 61 and shoulder 82. A second potential leak point is sealed at the seal 86 adjacent shoulder 45. In further embodiments, another potential leak point is sealed off at the juncture of the end seal 84, connector body 10 and overmold 78.

A third embodiment of a termination assembly for use under adverse weather conditions is illustrated in FIGS. 10 to 14 according to an exemplary embodiment, wherein like parts are correspondingly enumerated to those of the first embodiment. The components shown in FIGS. 10-14 are constructed for use under adverse weather conditions. According to an exemplary embodiment, in addition to or instead of the overmold assembly of the second embodiment, an O-ring seal 90 (e.g., a resilient member, etc.) is inserted in a groove 92 between end stop 62 (e.g., an insulator, etc.) and the end of extension 43' of inner body 43. Seal 90 is sized to engage extension wall 10' of a mating connector and become wedged firmly between the end of the extension wall 10' and extension 43' of inner body 43 when rear outer housing 69 is threaded into the closed position shown in FIG. 13. In this way, leak points are sealed off at opposite ends of spring housing 60 and seal 90 will effectively accomplish the same sealing ability as the overmold of the second embodiment. For example, any leakage through the entrance to the male socket end would be sealed off by O-ring 90.

In some embodiments, an additional sealing member, shown as O-ring or seal 79 (e.g., a weather seal, a resilient member, etc.), may be provided. Seal 79 may be disposed on an outer surface of forward outer housing 52 rearward of shoulder 54 such that when rear outer housing 58 is moved to a closed position, seal 79 provides a seal at the junction between forward outer housing 52 and rear outer housing 58. While seal 79 is shown as being an O-ring, any suitable seal may be utilized. In some embodiments, seal 79 may reside in an annular groove, or recess, formed in forward outer housing 52.

Figure 12:
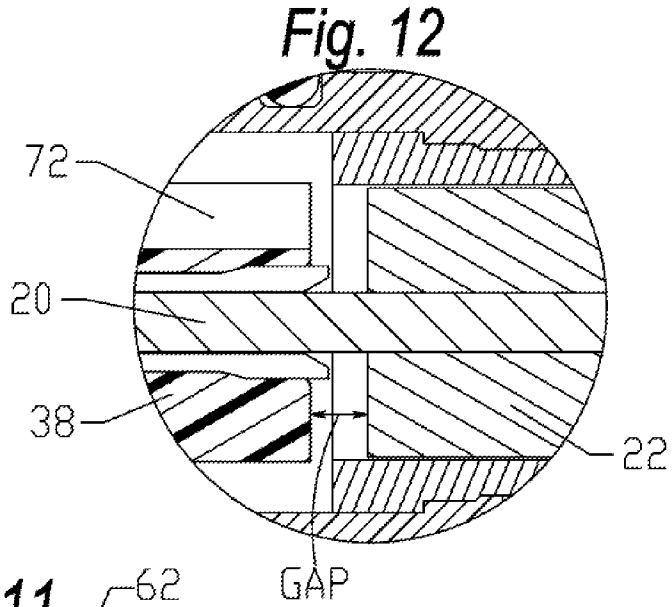
FIG. 12 is an enlarged detail view illustrating the circled portion of FIG. 11.
Figure 10:
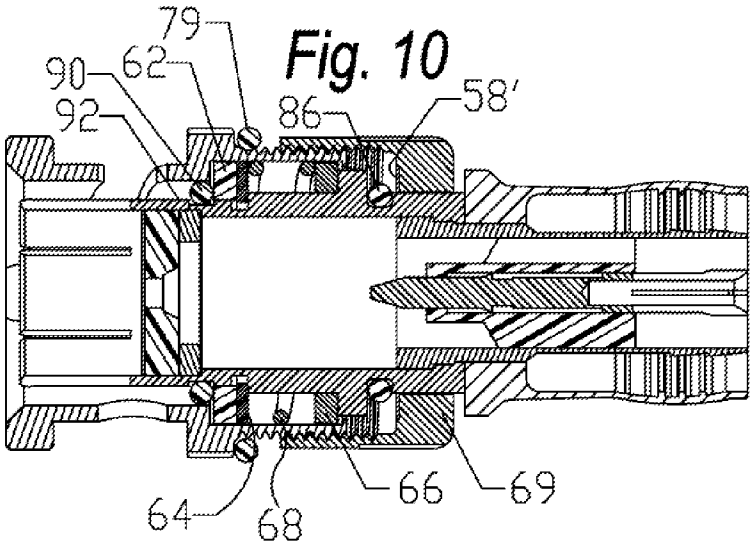
FIG. 10 is a longitudinal section view of a third embodiment of a BNC connector prior to assembly of the coaxial cables.
Figure 11:
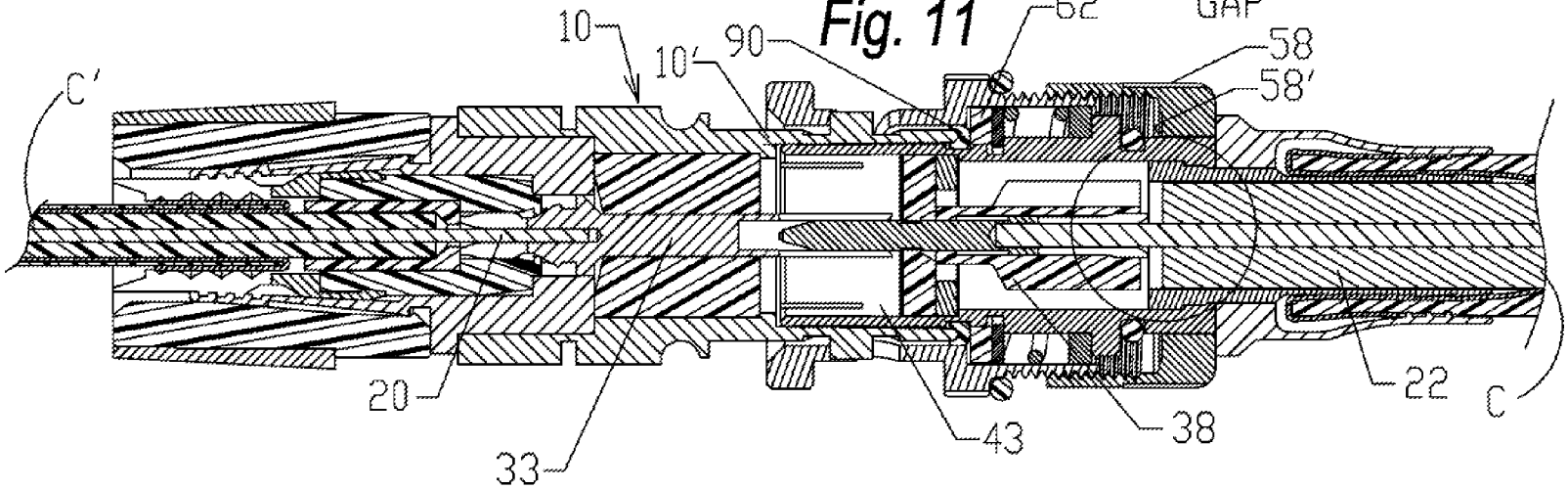
FIG. 11 is another longitudinal section view of the third embodiment assembled into a complete termination assembly.
Figures 13, 14:
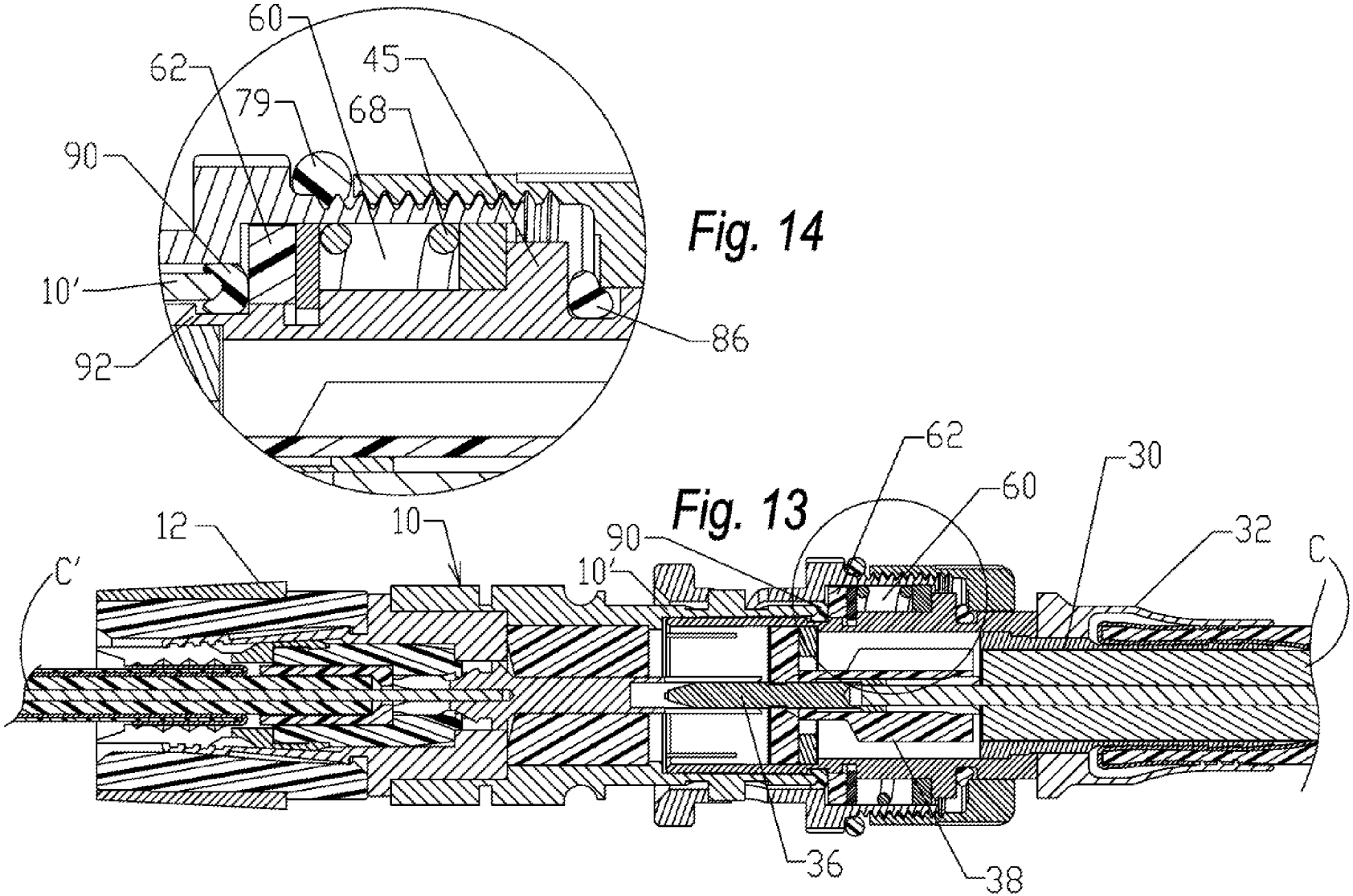
FIG. 13 is a longitudinal section view of the third embodiment with the BNC connector illustrated in a closed position.
FIG. 14 is an enlarged detail view of the circled portion of FIG. 13.

FIG. 12 illustrates in more detail the spacing or gap 71 between the dielectric 22 and facing end of center guide 38 which is another important factor in reducing return losses. For example, gap 71 may be established on the order of ⅛" with the leading end of center conductor 20 being fully inserted into the end of the center guide 38. Center guide 38 is designed with circumferentially spaced fins 73 which will compress center guide 38 around center conductor 20 and effectively wedge in place so as to maintain a constant gap 71.

Figure 16:
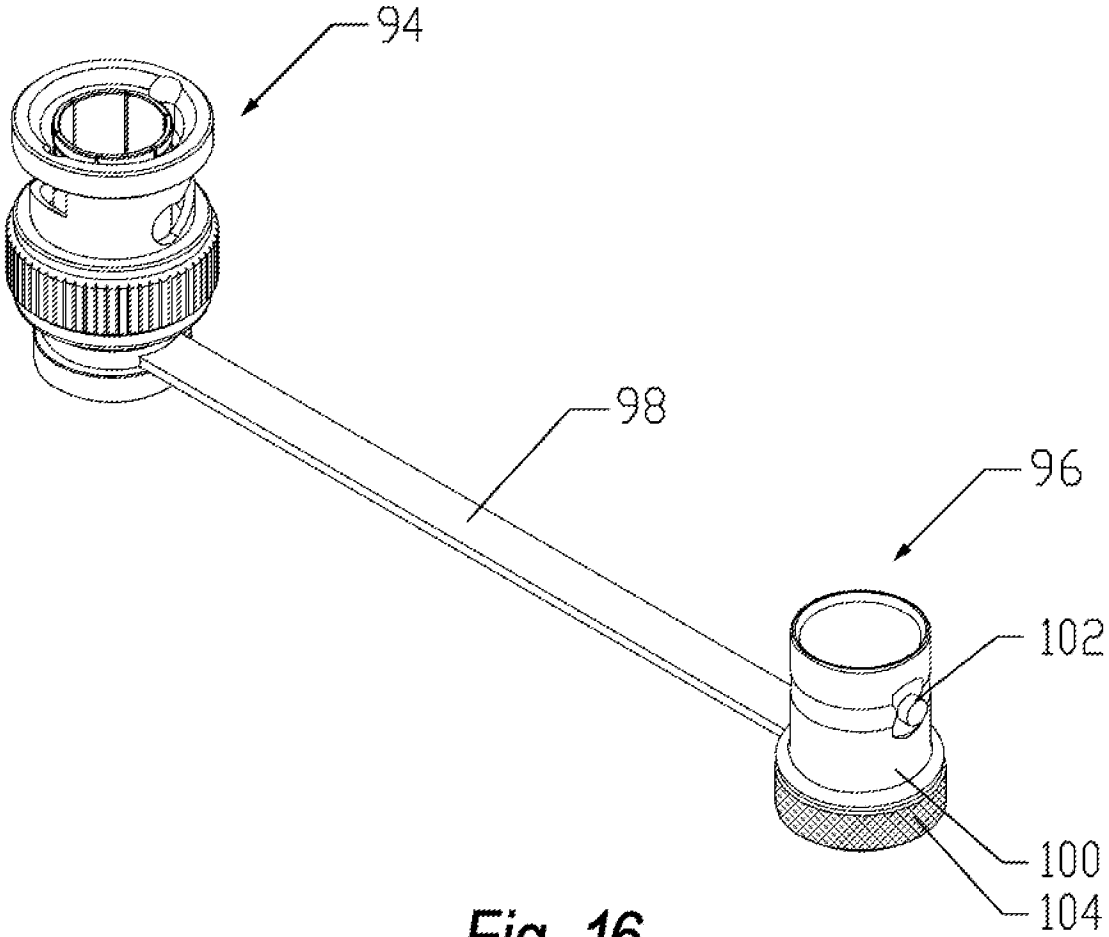
FIG. 16 is a perspective view of the connector and terminator of FIG. 14 disassembled from each other according to an exemplary embodiment.
Figure 15:
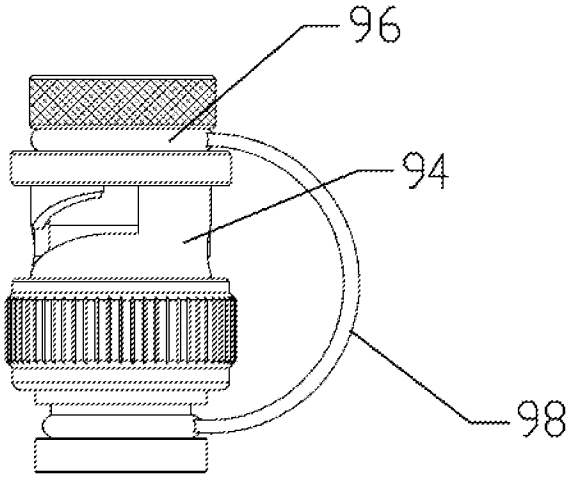
FIG. 15 is a side view of a connector and terminator assembled together according to an exemplary embodiment.

Referring to FIGS. 15-16, a BNC connector 94 is shown according to an exemplary embodiment. Connector 94 may incorporate any of the features discussed herein with respect to the various BNC connectors illustrated in FIGS. 2-14. In one embodiment, a terminator 96 (e.g., cover, cap, dust protector, sealing member, etc.) may be coupled to connector 94. According to an exemplary embodiment, terminator 96 is coupled to connector 94 via a lanyard 98.

According to an exemplary embodiment, terminator 96 may be a generally cylindrical member having a body portion 100, one or more pins 102, and a textured, or knurled portion 104. Body portion 100 is sized to closely fit within connector 94 is a manner similar to a typical mating connector, with pins 102 engaging the corresponding slots on connector 94. Textured portion 104 provides a griping surface to facilitate assembly and disassembly of terminator 96 and connector 94.

Lanyard 98 may have a first end coupled to connector 94 (e.g., a rearward portion of the connector) and a second end coupled to terminator 96. Lanyard 98 may take any suitable form, including a polymer or metal material, a band, chain, etc. When connector 94 is mated with a mating connector, terminator 96 may be left unterminated but attached to connector 94, as shown in FIG. 16 (mating connector not shown). When connector 94 is not mated with a mating connector, terminator 96 may be coupled to connector 94 using the standard bayonet pins/slots of BNC connectors. As such, terminator 96 may provide protection from adverse weather conditions, undesirable contaminants, etc., when connector 94 is not otherwise mated to a mating connector.

In some embodiments, a coaxial cable connector assembly includes a male connector half including a casing provided with at least one bayonet slot adjacent to one end of said casing, a spring in outer surrounding relation to said casing, and a telescoping enclosure for said spring being axially adjustable to advance said spring from an open position to a closed position; and a female connector half including an annular body in inner concentric relation to said casing, at least one bayonet pin on said body inserted into said slot for slidable movement through said slots whereupon axial adjustment of said spring causes advancement of said pins between an unlocked and locked position at opposite ends of said slots. The spring may be a compression spring.

In some embodiments said male connector half and said female connector half are locked against lateral displacement in response to advancement of said spring into a closed position. A seal may be mounted externally of one end of said male connector half. In some embodiments, the external seal is in the form of an annular sleeve in sealed relation to a said male connector half. The external seal may include O-rings mounted at opposite ends of said enclosure.

In further embodiments, a coaxial cable connector (e.g., connector 50) includes a forward outer housing (e.g., forward outer housing 52) comprising at least one slot and a rearward threaded portion, the at least one slot configured to receive a corresponding pin of a mating connector; a rear outer housing (e.g., rear outer housing 58) comprising a forward threaded portion configured to threadingly engage the rearward threaded portion of the forward outer housing such that the rear outer housing is moveable between a first position and a second position relative to the forward outer housing; and an inner body (e.g., inner body 43) extending through at least a portion of the forward outer housing and the rear outer housing; wherein the inner body is longitudinally displaceable relative to the forward outer housing when the rear outer housing is in the first position and wherein the inner body is longitudinally fixed relative to the forward outer housing when the rear outer housing is in the second position.

A basing member (e.g., biasing member 68) may be disposed between the inner body and at least one of the forward and rear outer housings, and may provide a biasing force tending to force the forward outer housing rearward relative to the inner body. The inner body may include an annular shoulder (e.g., shoulder 45) such that an end portion (e.g., end portion 59) of the rear outer housing member is axially spaced apart from the annular shoulder when the rear outer housing is in a first position (e.g., an open, or loosened position), and such that the end portion of the rear outer housing is adjacent or engages the annular shoulder when the rear outer housing is in a second position (e.g., a closed, or tightened position). The end portion may directly engage the annular shoulder, or alternatively, a resilient member (e.g., resilient member 86) such as an O-ring may be disposed between the annular shoulder and the end portion such that the resilient member is compressed when the rear outer housing is in the second position.

The forward outer housing and inner body may form an annular space in which a second resilient member (e.g., an o-ring such as o-ring 90) may be disposed. The inner body may include an annular groove or recess (e.g., groove 92) in which the second resilient member is seated. The resilient member may be configured to engage a forward portion of a mating connector and/or be wedged between the forward outer housing and the inner body.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is important to note that the construction and arrangement of the elements of the connector and related components as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure.

It is therefore to be understood that while different embodiments are herein set forth and described, various modifications and changes may be made in the specific construction and arrangement of the elements without departing from the spirit and scope of the embodiments herein illustrated and described and the following claims.

The following is claimed:

1. A coaxial cable connector comprising:

a first housing comprising a first portion;

a second housing comprising a second portion configured to engage the first portion such that the second housing is moveable relative to the first housing between a first position and a second position; and an inner body, part of the inner body being positioned within the first and second housings, the inner body configured to be:

(a) moveable relative to the first housing when the second housing is in the first position; and (b) stationary relative to the first housing when the second housing is in the second position.

2. The coaxial cable connector of claim 1, comprising a biasing member disposed between the inner body and at least one of the first and second housings.

3. The coaxial cable connector of claim 2, the biasing member providing a biasing force configured to force the first housing rearward relative to the inner body.

4. The coaxial cable connector of claim 3, the biasing member comprising a coil spring.

5. The coaxial cable connector of claim 1, the inner body comprising an exterior surface and an annular shoulder extending from the exterior surface.

6. The coaxial cable connector of claim 5, the second housing comprising an end portion, the end portion configured to be: (a) axially spaced apart from the annular shoulder when the second housing is in the first position; and (b) engaged with the annular shoulder when the second housing is in the second position.

7. The coaxial cable connector of claim 5, comprising a resilient member positioned between the second housing and the inner body, the resilient member configured to be compressible in a longitudinal direction when the second housing is moved to the second position.

8. The coaxial cable connector of claim 7, the resilient member comprising an O-ring.

9. The coaxial cable connector of claim 1, comprising a resilient member disposed within an annular space defined by the first housing and the inner body.

10. The coaxial cable connector of claim 9, the resilient member being configured to engage a forward portion of a mating connector.

11. The coaxial cable connector of claim 10, the inner body comprising an annular groove, where the resilient member is at least partially positioned within the annular groove.

12. The coaxial cable connector of claim 1, comprising a terminator coupled to at least one of the first and second housings, the terminator configured to engage the first housing.

13. The coaxial cable connector of claim 1, the first housing being configured to threadingly engage the second housing.

14. The coaxial cable connector of claim 1, comprising a compressible member, the compressible member extending over at least a portion of the first housing, and the compressible member being configured to engage a forwardmost portion of the second housing when the second housing is in the second position.

15. A coaxial cable connector comprising:

a first outer housing comprising a rearward portion;

a second outer housing comprising a forward portion configured to engage the rearward portion such that the second outer housing is moveable between a first position and a second position relative to the first outer housing; and an inner body extending along an axis, part of the inner body being positioned within the first outer housing and the second outer housing, the inner body configured to be:

(a) moveable along the axis relative to the first outer housing when the second outer housing is in the first position; and (b) stationary on the axis relative to the first outer housing when the second outer housing is in the second position.

16. The coaxial cable connector of claim 15, comprising a resilient member disposed between the second outer housing and the inner body.

17. The coaxial cable connector of claim 15, comprising a resilient member disposed between the first outer housing and the second outer housing.

18. A coaxial cable connector comprising:

a forward housing extending along an axis, the forward housing comprising a rearward portion;

a rearward housing comprising a forward portion configured to engage the rearward portion such that the rearward housing is moveable between a first position and a second position relative to the forward housing; and an inner body, part of the inner body being positioned within the forward housing and the rearward housing, the inner body configured to be:

(a) moveable off of the axis when the rearward housing is in the first position; and (b) stationary on the axis when the rearward housing is in the second position.

19. The coaxial cable connector of claim 18, comprising a resilient member positioned between the rearward housing and the inner body.

20. The coaxial cable connector of claim 18, comprising a resilient member positioned between the forward housing and the rearward housing.

21. A cable connector, comprising:

a first housing having a portion;

a second housing configured to rotatably engage the portion of the first housing to enable the second housing to move axially relative to the first housing between a first position and a second position, the first housing and the second housing configured to form an interior space; and an inner body, part of the inner body configured to be positioned within the interior space of the first and second housings, the inner body configured to be axially moveable from a first inner body position associated with the first position of the second housing to a second inner body position associated with the second position of the second housing, wherein the cable connector is configured so that axial movement of the second housing from the first position to the second position causes the cable connector to block ingress of an environmental element into the interior space and also axially secure the inner body part to prevent lateral displacement of a conductive element disposed in the cable connector.

22. The cable connector of claim 21, further comprising a first seal element disposed about the inner body and in position near the second housing, wherein the second housing is configured to contact the seal element in the second position.

23. The cable connector of claim 22, wherein the first seal element is configured to deform in response to contact from the second housing.

24. The cable connector of claim 22, further comprising a second seal element disposed about the inner body and in position to contact a mating connector, which is configured to couple with said cable connector, with the second housing in the second position.

25. The cable connector of claim 21, further comprising a first sleeve disposed on at least a portion of the first housing, wherein the second housing can include a projection that is configured to contact the first sleeve in the second position.

26. The cable connector of claim 25, further comprising a second sleeve disposed interior to the first sleeve, wherein the second sleeve is configured to secure to the first housing.

27. The cable connector of claim 25, wherein the first sleeve comprises a compressible member that is configured to deform in response to contact from the projection.

28. The cable connector of claim 21, wherein the inner body has one or more external shoulders, and wherein the second housing is configured to exert a force onto the one or more external shoulders in the second position.

29. The cable connector of claim 28, further comprising a spring interposed between the second housing and the one or more external shoulders.

30. The cable connector of claim 29, wherein the inner body comprises one or more thin-walled projections that extend away from the second housing towards the mating connector, and wherein positioning of the second housing in the second position is configured to prevent lateral displacement of the one or more thin-walled projection and a mating connector that is configured to couple with said cable connector.

31. The coaxial cable connector of claim 1, wherein movement of the second housing from the first position to the second position configures said cable connector to prevent lateral movement of a mating connector that is configured to couple to an end of said cable connector to prevent distortion of frequencies in signals that said cable connector is configured to conduct between a first cable configured on said cable connector and a second cable configured on the mating connector.

32. The coaxial cable connector of claim 1, wherein movement of the second housing from the first position to the second position configures said cable connector to prevent axial movement of one or more components disposed in an interior space formed by the first housing and the second housing.

33. The coaxial cable connector of claim 1, wherein movement of the second housing from the first position to the second position configures said cable connector to prevent lateral displacement of a conductive element that is configured to interface with a mating connector that is configured to couple with said cable connector to reduce return loss in a signal that said cable connector is configured to conduct between a first cable configured on said cable connector and a second cable configured on a mating connector that is configured to connect to said cable connector.

34. The coaxial cable connector of claim 1, wherein axial movement of said second housing from the first position to the second position configures said cable connector to prevent ingress of an environmental element into an interior space formed by the first housing and the second housing.

35. The coaxial cable connector of claim 15, wherein movement of the second housing from the first position to the second position configures said cable connector to prevent lateral movement of a mating connector that is configured to couple to an end of said cable connector to prevent distortion of frequencies in signals that said cable is configured to conduct from a first cable configured on said cable connector and a second cable configured on the mating connector.

36. The coaxial cable connector of claim 15, wherein movement of the second housing from the first position to the second position configures said cable connector to prevent axial movement of one or more components disposed in an interior space formed by the first housing and the second housing.

37. The coaxial cable connector of claim 15, wherein movement of the second housing from the first position to the second position configures said cable connector to prevent lateral displacement of a conductive element that is configured to interface with a mating connector that is configured to couple with said cable connector to reduce return loss in a signal that said cable is configured to conduct from a first cable configured on said cable connector and a second cable configured on the mating connector.

38. The coaxial cable connector of claim 15, wherein axial movement of said second housing from the first position to the second position configures said cable connector to prevent ingress of an environmental element into an interior space formed by the first housing and the second housing.

39. The coaxial cable connector of claim 18, wherein movement of the second housing from the first position to the second position configures said cable connector to prevent lateral movement of a mating connector that is configured to couple to an end of said cable connector to prevent distortion of frequencies in signals that said cable is configured to conduct from a first cable configured on said cable connector and a second cable configured on the mating connector.

40. The coaxial cable connector of claim 18, wherein movement of the second housing from the first position to the second position configures said cable connector to prevent axial movement of one or more components disposed in an interior space formed by the first housing and the second housing.

41. The coaxial cable connector of claim 18, wherein movement of the second housing from the first position to the second position configures said cable connector to prevent lateral displacement of a conductive element that is configured to interface with a mating connector that is configured to couple with said cable connector to reduce return loss in a signal that said cable is configured to conduct from a first cable configured on said cable connector and a second cable configured on the mating connector.

42. The coaxial cable connector of claim 18, wherein axial movement of said second housing from the first position to the second position configures said cable connector to prevent ingress of an environmental element into an interior space formed by the first housing and the second housing.

* * * * *